US007874540B2

(12) United States Patent
Niu

(10) Patent No.: US 7,874,540 B2
(45) Date of Patent: Jan. 25, 2011

(54) CONCRETE FORM FOR POURING NON-ROUND COLUMNS, AND METHOD OF MAKING SAME

(75) Inventor: Xiaokai Niu, Hartsville, SC (US)

(73) Assignee: Sonoco Development, Inc., Hartsville, SC (US)

( * ) Notice: Subject to any disclaimer, the term of this patent is extended or adjusted under 35 U.S.C. 154(b) by 708 days.

(21) Appl. No.: 11/769,266

(22) Filed: Jun. 27, 2007

(65) Prior Publication Data

US 2009/0001247 A1 Jan. 1, 2009

(51) Int. Cl.
*E04G 13/02* (2006.01)

(52) U.S. Cl. ..... 249/48; 249/51; 29/469

(58) Field of Classification Search ..... 248/48, 248/49, 50, 51, 112; 264/32; 52/745.17; 29/458, 469, 897, 897.3, 897.33, 897.34
See application file for complete search history.

(56) References Cited

U.S. PATENT DOCUMENTS

| | | | | |
|---|---|---|---|---|
| 1,299,739 | A * | 4/1919 | Landwehr | 249/48 |
| 2,873,503 | A * | 2/1959 | Davis | 249/48 |
| 2,975,498 | A | 3/1961 | Plattner | |
| 3,301,926 | A * | 1/1967 | Reiland | 264/46.5 |
| 3,350,049 | A * | 10/1967 | Reiland | 249/48 |
| 3,567,173 | A * | 3/1971 | Peterson | 249/183 |
| 3,588,027 | A * | 6/1971 | Bowden | 249/48 |
| 3,990,672 | A * | 11/1976 | Buchanan | 249/48 |
| 4,767,095 | A * | 8/1988 | Fitzgerald et al. | 249/48 |
| 6,260,816 | B1 * | 7/2001 | Valero Salinas | 249/48 |
| 6,467,749 | B1 * | 10/2002 | van de Camp | 249/48 |
| 6,997,427 | B2 * | 2/2006 | Manthei | 249/83 |
| 2005/0066592 | A1 | 3/2005 | Huber et al. | |
| 2006/0016150 | A1 | 1/2006 | Fournier | |

FOREIGN PATENT DOCUMENTS

| | | |
|---|---|---|
| DE | 44 31 086 | 3/1996 |
| EP | 0 440 587 | 8/1991 |
| EP | 0 515 952 | 12/1992 |
| EP | 0 595 679 | 5/1994 |
| ES | 2 113 777 | 5/1998 |
| FR | 2 684 124 | 5/1993 |
| WO | WO 93/14287 | 7/1993 |
| WO | WO 2005/083199 | 9/2005 |

* cited by examiner

*Primary Examiner*—Michael Safavi
*Assistant Examiner*—Joshua Rodden
(74) *Attorney, Agent, or Firm*—Alston & Bird LLP

(57) ABSTRACT

A concrete form comprises a single insert assembly or a plurality of insert assemblies within an outer tube. Each insert assembly comprises a pre-formed polymer liner sheet, a pre-formed polymer backing sheet, and a plurality of prefabricated cellular material pieces. Each cellular material piece has a first surface configured to form a portion of the non-round cross-section desired for the column and an opposite second surface formed substantially as an angular section of a cylinder. An insert assembly is constructed by affixing the liner sheet to the first surfaces of a plurality of the cellular material pieces. The cellular material pieces are arranged in a plurality of laterally adjacent rows extending lengthwise along the liner sheet for a length approximately equal to the length of the outer tube. The backing sheet is then fixed to the second surfaces of the cellular material pieces. The liner sheet and backing sheet together substantially fully envelope the cellular material pieces.

13 Claims, 5 Drawing Sheets

CONCRETE FORM FOR POURING NON-ROUND COLUMNS, AND METHOD OF MAKING SAME

BACKGROUND OF THE INVENTION

The present disclosure relates to forms for pouring concrete columns, and particularly relates to concrete forms for pouring non-round columns, such as rectangular or square columns.

A wide variety of concrete forms for pouring columns have been developed over the years. Forms constructed from lumber and plywood have been used in the past, but are relatively complicated and require substantial skill on the part of the worker to construct. Additionally, wooden forms are relatively expensive.

More recently, it has become conventional to pour concrete columns using a form comprising a wound paperboard tube lined with some type of impervious liner. These forms are less costly than wooden forms and have proven to be very successful, but are limited to the formation of round columns. Various modifications of this basic type of form for making non-round columns have been proposed. Most of these modifications entail forming an insert that defines an inner channel having the desired non-round cross-section. The insert often is formed in part by polymer foam such as polyurethane foam or expanded polystyrene. The insert is positioned within an outer tube such as a wound paperboard tube. Concrete is poured into the inner channel of the insert. Once the concrete cures, the outer tube is removed and then the insert is stripped off the concrete column.

Some of these forms for non-round columns have inserts that are not amenable to being assembled in the field and thus must be pre-assembled in the factory and then shipped to the jobsite. The forms shipped in this manner are bulky and therefore shipping costs are relatively high. Additionally, some of these forms are not amenable to being stripped from the concrete column in a manner allowing the insert to be reused one or more additional times. In the case of forms that employ polymer foam, in many instances the foam becomes exposed and torn or disintegrated as the insert is stripped from the column. Tiny foam pieces then are blown about the jobsite by the wind.

It would be desirable to provide a form for non-round columns that is readily assembled in the field, has at least partial reusability, is amenable to nesting of multiple forms to reduce volume and hence shipping costs, and is relatively simple and inexpensive to produce.

BRIEF SUMMARY OF THE DISCLOSURE

The present disclosure relates to forms for pouring a non-round concrete column, and to methods for making such forms. In accordance with one embodiment, a concrete form is made by positioning an insert within an outer tube. The insert can comprise a single insert assembly or a plurality of insert assemblies. Each insert assembly comprises a pre-formed polymer liner sheet, a pre-formed polymer backing sheet, and a plurality of prefabricated cellular material pieces. Each cellular material piece has a first surface configured to form a portion of the non-round cross-section desired for the column and an opposite second surface formed substantially as an angular section of a cylinder. The lengths of the cellular material pieces are such that a plurality of the cellular material pieces arranged end-to-end in a row collectively have a length approximately equal to the length of the outer tube. An insert assembly is constructed by affixing the liner sheet to the first surfaces of a plurality of the cellular material pieces. The cellular material pieces are arranged in a plurality of laterally adjacent rows extending lengthwise along the liner sheet. Each row comprises a plurality of the cellular material pieces arranged end-to-end, which collectively have a length approximately equal to the length of the outer tube. The backing sheet is affixed to the second surfaces of the cellular material pieces. The liner sheet and backing sheet together substantially fully envelope the cellular material pieces.

A single insert assembly can be formed to have three or more rows of the cellular material pieces configured in such a manner that the insert assembly can be slid into the outer tube and then arranged such that the backing sheet abuts the inner surface of the tube and the liner sheet on the first surfaces of the cellular material pieces defines the desired non-round cross-section to be imparted to a column. The insert assembly formed in this manner is advantageous in that it can be folded into a generally flattened configuration for shipping and storage prior to being used, and multiple inserts can be nested or stacked in a relatively space-efficient manner. Outer tubes of different diameters can also be nested one within another to save space. The insert assembly is relatively rigid and robust, and is light in weight and easily handled by one person even in relatively long lengths. The construction of the insert assembly from multiple cellular material pieces of relatively short length makes it simple to form an insert assembly of any desired length. Furthermore, because the cellular material pieces are enveloped by the liner and backing sheets, the cellular material is protected and prevented from being torn and disintegrated.

In some embodiments, the cellular material comprises polymer foam. The insert assembly formed in this manner is substantially unaffected by exposure to water since it is formed of polymer foam and polymer sheets. Accordingly, the insert assemblies potentially can be reused multiple times.

In another embodiment, two (or more) insert assemblies are formed each having two (or more) rows of the cellular material pieces enveloped between liner and backing sheets. The insert assemblies are positioned in the outer tube such that they collectively define the desired cross-section.

The methods and apparatus in accordance with the present disclosure are suitable for making concrete columns of various cross-sectional shapes, including polygonal cross-sections having three, four, or more sides, as well as cross-sections of non-polygonal shape.

The method in accordance with one embodiment is a continuous linear process for making an insert assembly of indefinite length. Thus, a continuous liner sheet of indefinite length is joined to a plurality of cellular material pieces of finite length arranged in rows of indefinite length, and a continuous backing sheet of indefinite length is joined to the other sides of the cellular material pieces such that the cellular material pieces are substantially fully enveloped between the liner and backing sheets.

BRIEF DESCRIPTION OF THE SEVERAL VIEWS OF THE DRAWING(S)

Having thus described the disclosure in general terms, reference will now be made to the accompanying drawings, which are not necessarily drawn to scale, and wherein:

DETAILED DESCRIPTION OF THE DRAWINGS

The present invention now will be described more fully hereinafter with reference to the accompanying drawings in which some but not all embodiments of the inventions are shown. Indeed, these inventions may be embodied in many different forms and should not be construed as limited to the embodiments set forth herein; rather, these embodiments are provided so that this disclosure will satisfy applicable legal requirements. Like numbers refer to like elements throughout.

Figure 1:
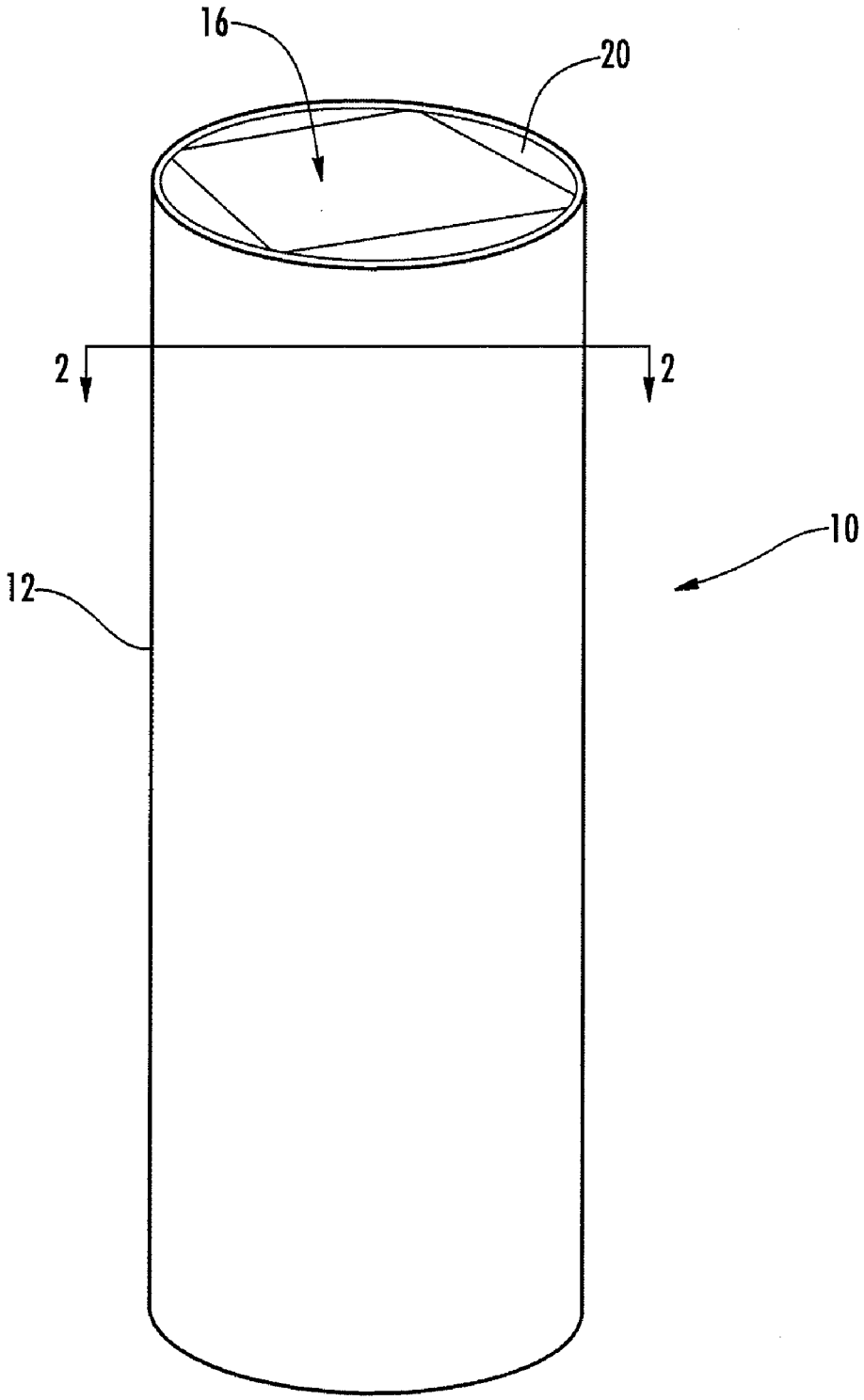
FIG. 1 is a perspective view of a concrete form in accordance with one embodiment of the invention.

A concrete form 10 in accordance with one embodiment of the invention is illustrated in FIG. 1. The form 10 is used for pouring a concrete column having a rectangular or square cross-section with chamfered or beveled corners. The form comprises an outer tube 12 that provides structural strength and rigidity to the form, and a least one insert assembly 20 that is formed separately from the outer tube 12 and is slid axially into the outer tube at the jobsite. The insert assembly 20 serves to define an internal channel 16 having the desired cross-sectional shape to be imparted to the concrete that will be poured into the form. The form 10 can be assembled at the jobsite or can be assembled at another location and transported to the jobsite.

The outer tube 12 can have various constructions and can be formed of various materials. The outer tube has an inner surface that is substantially cylindrical with a circular cross-section. A suitable material for the outer tube is paperboard. The outer tube can be formed by either spirally or convolutely winding a plurality of layers of paperboard about a cylindrical mandrel and adhering the layers together with a suitable adhesive such as an aqueous adhesive or the like. The length of the tube is made at least as great as the desired length of the column to be produced. The inside diameter of the tube is selected based on the dimensions of the cross-section of the column and the dimensions of the insert assembly 20 required to produce that cross-section. The wall thickness of the outer tube is selected in order to provide sufficient bending stiffness and hoop strength to maintain structural integrity of the tube under the loads imposed by the column of concrete to be poured into the form. Generally, the outer tube is designed to be used only once, and it will be stripped from the concrete column and discarded.

Figure 2:
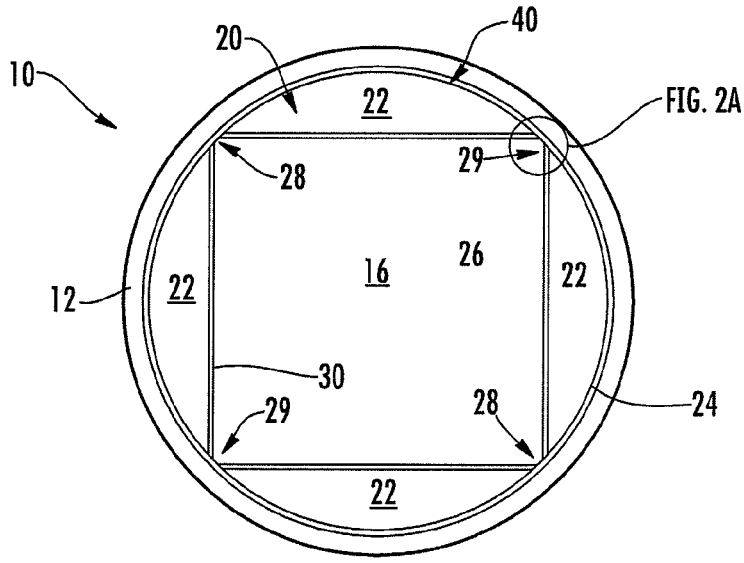
FIG. 2 is a cross-sectional view along line 2-2 in FIG. 1.

With reference to FIG. 2, the form 10 is shown in cross-sectional view. The insert assembly 20 comprises a plurality of prefabricated cellular material pieces 22 that serve to define the desired cross-sectional shape for the internal channel 16 of the form. By "prefabricated", it is meant that the cellular material pieces are formed in a process outside the interior of the outer tube 12, as opposed to being formed in situ within the outer tube such as by injecting a foaming composition into spaces in the tube. For instance, the cellular material pieces can be formed by an extrusion process, as well known in the art. Each cellular material piece 22 has a radially outer surface 24 configured as an angular section of a cylinder so that it substantially conforms to the inner surface of the outer tube 12. The opposite radially inner surface 26 of each cellular material piece is configured to form a portion of the outer surface of the concrete column. Thus, in the illustrative example in the drawings, the column is substantially square or rectangular, and therefore the inner surfaces 26 of the cellular material pieces are substantially planar.

The cellular material pieces 22 can be formed of any of various polymer foams including foamed polyolefins (e.g., polyethylene), polyurethane, polyisocyanate, or expanded polystyrene (EPS), or can be formed of a paper honeycomb material or the like. Cellular material pieces made of EPS have the advantages of being lightweight while still possessing adequate strength and stiffness. When the pieces 22 comprise polymer foam, the foam density depends on the column height (liquid head pressure from the concrete) and is selected to be sufficient to minimize compressive deformation of the foam. Typically the foam density can range from about 0.5 $lb/ft^3$ to about 3.0 $lb/ft^3$.

The cellular material pieces 22 are substantially fully enveloped between a preformed polymer liner sheet 30 and a preformed polymer backing sheet 40. By "preformed", it is meant that the liner and backing sheets are formed in a process outside the interior of the tube 12 and prior to being brought together with the cellular material pieces (e.g., the liner sheet is not formed by spraying a polymer composition onto the inner surfaces of the cellular material pieces 22 after the cellular material pieces are placed into the outer tube). For example, the sheets can be formed by extrusion or casting as well known in the art of polymer film production. The sheets 30, 40 can be formed of any of various polymers, including polyvinyl chloride, polypropylene, polyethylene, polystyrene, polyester, polyamide, polytetrafluoroethylene, or the like. The sheets 30, 40 advantageously should be light in color (e.g., white) or transparent so that they do not become too hot when exposed to sunlight for extended periods of time. The liner sheet 30 and backing sheet 40 each can range in thickness from about 0.015 inch to about 0.060 inch (about 0.38 mm to about 1.5 mm). A suitable non-limiting thickness for a polypropylene liner sheet 30 is about 0.040 inch (about 1 mm), and a suitable non-limiting thickness for a polypropylene backing sheet 40 is about 0.020 inch (about 0.5 mm). It should be understood that there is no theoretical upper limit to the film thickness. The recited upper limit of about 0.060 inch is merely preferred, because films thicker than this are more expensive, leave more-noticeable lines on the concrete column (in the case of the liner sheet), are heavier and thus more cumbersome to transport in large quantities, and are difficult to wind up into a roll. Sheets thicker than about 0.060 inch also tend to have significant bending stiffness and memory such that the elastic resilience of the sheet resists bending of the sheet into an L-shape as required when inserting the insert assembly into the outer tube. A thicker sheet could still be used, but it likely would have to be scored to allow it to bend as necessary.

It is often desired to form concrete columns of substantial length, such as 12 feet or more. While a single cellular material piece 22 extending continuously for such a length can be formed, it has been found that such long cellular material pieces are not dimensionally stable. For example, 12-foot long EPS pieces tend to bow like a banana. Additionally, it is very difficult to accurately control the dimensions of a very long foam piece when forming it by hot wire cutting from a foam block. Accordingly, in accordance with the invention, a plurality of shorter cellular material pieces 22 are arranged end-to-end in order to provide the needed length.

Figure 3:
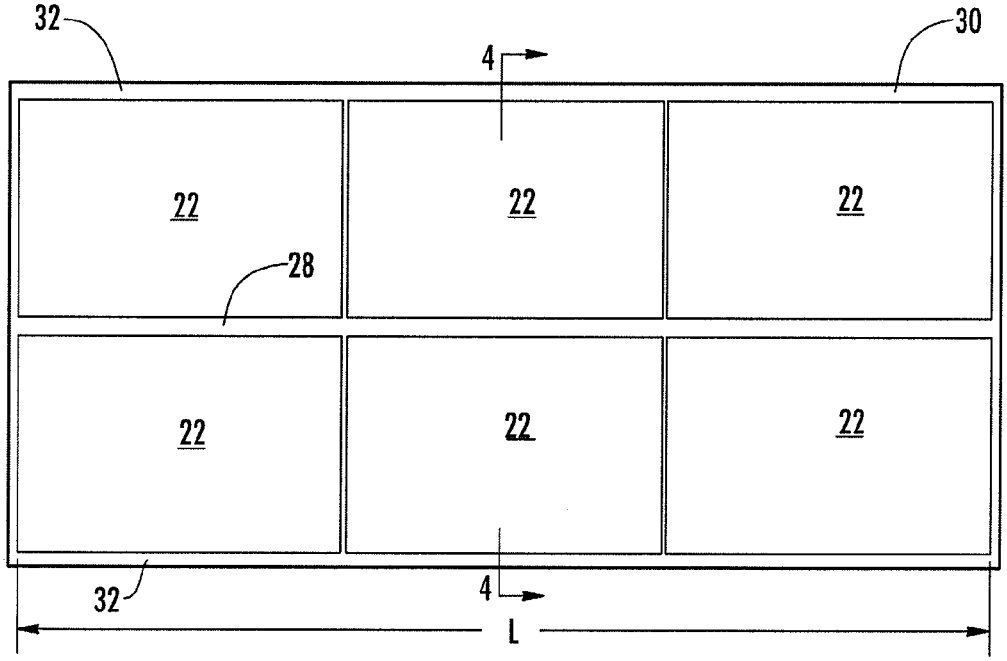
FIG. 3 is a plan view of a portion of an insert assembly in accordance with one embodiment of the invention.

FIG. 3 illustrates this construction. The production of an insert assembly 20 begins by providing a preformed liner sheet 30 having a length approximately equal to the length L of the outer tube 12. The liner sheet is laid flat on a suitable planar surface. A plurality of cellular material pieces 22 of the appropriate cross-sectional shape are then arranged on the liner sheet, with the inner surfaces 26 (FIG. 2) of the cellular material pieces against the liner sheet. An adhesive is first applied either to the liner sheet or to the inner surfaces of the cellular material pieces in order to affix the liner sheet to the cellular material pieces. The cellular material pieces are arranged in a plurality of rows extending lengthwise along the liner sheet. In the example of FIG. 3, two rows of the cellular material pieces are provided. Each row is made up of a plurality of cellular material pieces arranged end-to-end such that the collective length of the cellular material pieces is approximately equal to L. In FIG. 3, small gaps are shown between the juxtaposed ends of the cellular material pieces, but these gaps are shown only for illustrative purposes. It is desired to minimize such gaps as much as possible. The liner sheet 30 is shown as being slightly longer than the rows of cellular material pieces 22, although this is not a necessity; however, the liner sheet preferably should be at least as long as the rows of cellular material pieces.

A gap 28 is provided between the adjacent side edges of the two rows of cellular material pieces. Additionally, the liner sheet 30 is wider than the overall width of the rows of cellular material pieces, and the opposite side edges 32 of the liner sheet extend laterally beyond outer side edges of the cellular material pieces. As further explained below, the gap 28 and the side edges 32 are employed for forming chamfered or beveled corners on the concrete column.

In the embodiment illustrated in FIG. 3, the insert assembly 20 is one of two separately formed insert assemblies that are used within the outer tube. The two insert assemblies together define the desired cross-section for the column to be formed. This arrangement is beneficial particularly for columns of large cross-sectional dimensions, where a single insert assembly defining all sides of the column would be too large and unwieldy to be easily handled by a worker. For example, it is often desired to form a square column 24 inches by 24 inches in cross-section. A single insert assembly having four rows of cellular material pieces each approximately 24 inches wide would have a total width of about 96 inches. By providing two insert assemblies each about 48 inches wide, the insert assemblies can be handled more readily.

Figure 4:
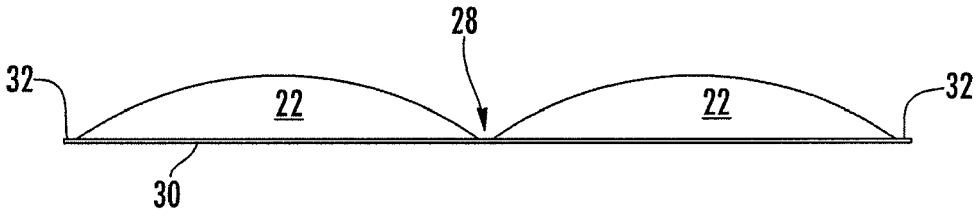
FIG. 4 is a cross-sectional view along line 4-4 in FIG. 3.
Figure 5:
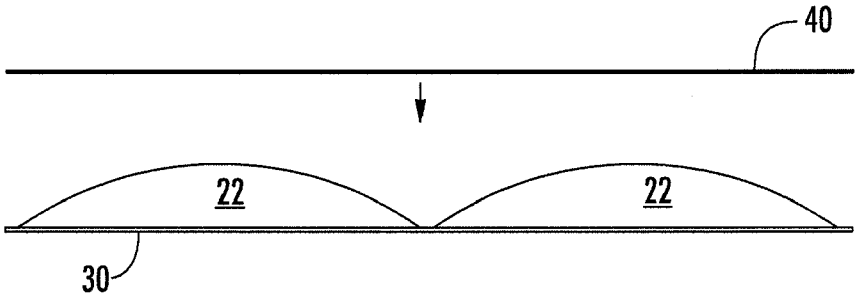
FIG. 5 is a view similar to FIG. 4, showing a further step in constructing the insert assembly.
Figure 6:
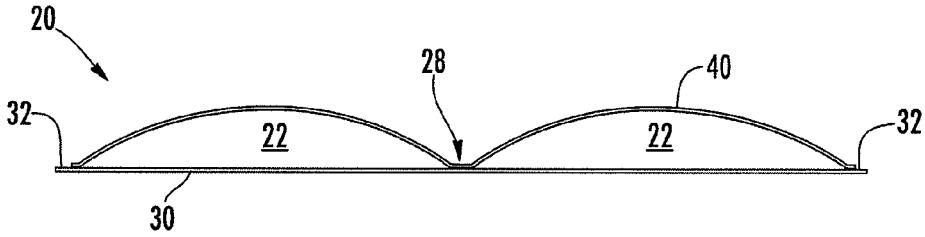
FIG. 6 is a cross-sectional view of the completed insert assembly.

Thus, in accordance with the embodiment of FIG. 3, two substantially identical insert assemblies are constructed (although it is not essential that the insert assemblies be substantially identical). FIG. 3 illustrates a first step in the process of making each insert assembly, and FIG. 4 shows a cross-section through the partial assembly. FIG. 5 illustrates the completion of the process of making each insert assembly. A preformed backing sheet 40 is placed against the radially outer surfaces of the cellular material pieces. An adhesive is first applied either to the backing sheet or to the outer surfaces of the cellular material pieces and the surfaces of the liner sheet 30 that the backing sheet will contact. Although FIG. 5 shows a single backing sheet 40 for two rows of cellular material pieces, alternatively each row of cellular material pieces can have its own separate backing sheet, in which case the width of each backing sheet 40 can be slightly smaller than the arc distance along the outer surface of the cellular material pieces, such that neither edge of the backing sheet extends beyond the edges of the cellular material pieces. A strip of pressure-sensitive adhesive tape (not shown) can be applied so as to bridge between each edge of the backing sheet and the inner surface of the liner sheet to substantially seal the interfaces between the sheets. As an alternative production process, it is possible to use a heat-shrink pocket (i.e., heat-shrinkable film material formed as a pocket); the cellular material pieces are placed into the pocket and the film material is heated to shrink it around the foam pieces. Various other ways of substantially fully enveloping the cellular material pieces in film material can be used as well. By "substantially fully enveloping" is meant that the inner and outer surfaces of the cellular material pieces are substantially covered by the sheets, but the end surfaces of the endmost cellular material pieces in each row are not necessarily covered by the sheets. FIG. 6 shows a cross-sectional view of the completed insert assembly 20.

Each insert assembly 20 has substantial rigidity against bending about axes parallel to the width direction of the liner and backing sheets. Such rigidity is achieved by the enveloping of the cellular material pieces by the liner and backing sheets and their attachment to the cellular material pieces, as well as by the abutment of the end surfaces of the cellular material pieces in each row. However, as will be appreciated, each insert assembly can readily bend about a longitudinal axis in the region of the gap 28 between the rows of cellular material pieces 22. Furthermore, the insert assemblies can be folded about this gap region so that one row of cellular material pieces lies atop the other row of cellular material pieces, with the planar sides of the cellular material pieces facing each other, thereby reducing the overall width of the insert assemblies by about half, which can be useful for shipping and storing of the insert assemblies. Folding the insert assemblies in this manner also facilitates insertion of the insert assemblies into the outer tube 12 (FIG. 2).

The concrete form 10 having two insert assemblies 20 is used in the following manner. At the jobsite, an outer tube 10 of suitable length and inside diameter for the column to be produced is placed on a support surface in a horizontal orientation. One of the insert assemblies 20 is at least partially folded as described above and is inserted into the outer tube until the opposite ends of the insert assembly are approximately flush with the opposite ends of the tube. The insert assembly is unfolded such that the backing sheet 40 on the cellular material pieces 22 abuts the inner surface of the outer tube. In this condition, the planar inner surface of one row of cellular material pieces is substantially perpendicular to the planar inner surface of the other row of cellular material pieces. Next, the second insert assembly 20 is inserted into the tube in the same manner and is positioned and unfolded such that the planar inner surfaces of the two insert assemblies form the desired square or rectangular cross-section. The insert assemblies are designed such that there are gaps 29 between one row of cellular material pieces of one insert assembly and the adjacent row of cellular material pieces of the other insert assembly. The insert assemblies can be secured to the outer tube to fix them in place using tape, clips, screws, staples, glue, etc.

Figure 2A:
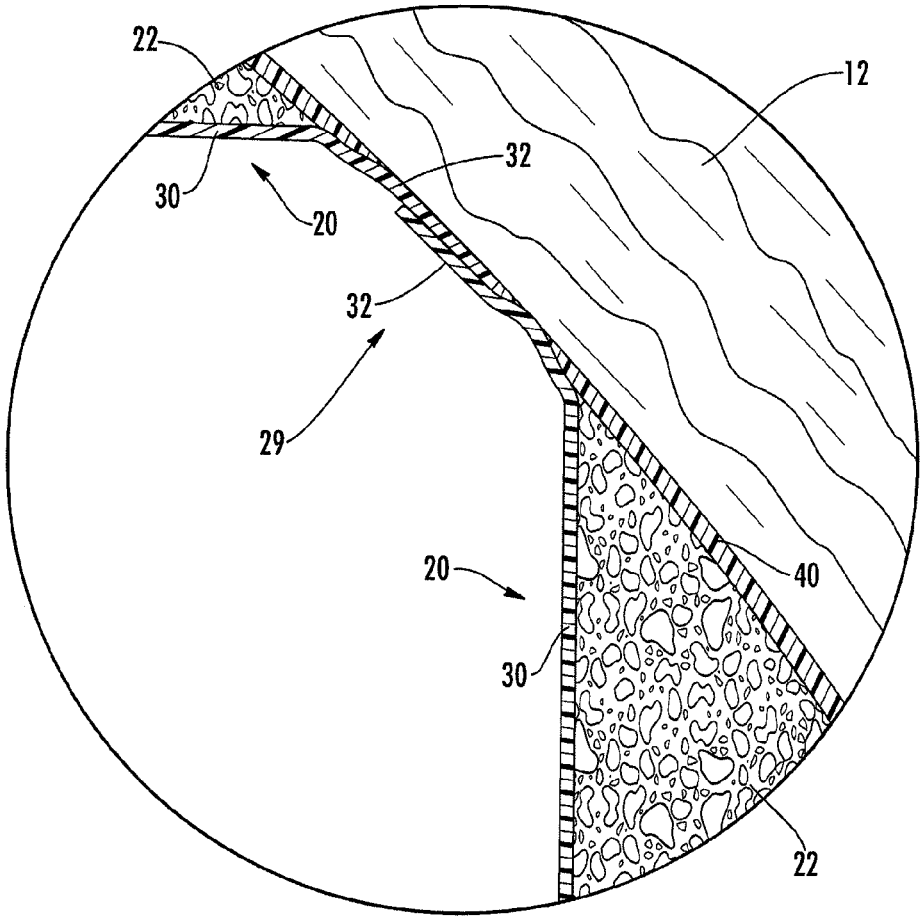
FIG. 2A is a greatly enlarged portion of FIG. 2.

With reference to FIG. 2A showing one of these gaps 29, it is advantageous to configure and arrange the insert assemblies 20 such that the side edge 32 of the liner sheet 30 of one insert assembly 20 overlaps the side edge 32 of the liner sheet 30 of the other insert assembly 20. It has been found that by suitably making the liner sheets in terms of composition and thickness, this overlapping of the side edges 32 creates a substantially self-sealing seam that substantially prevents concrete water from leaking through, even though the side edges 32 are not sealed with an adhesive or sealant. For example, the liner sheets 30 can be formed of polypropylene and can have a thickness of about 0.015 inch (0.38 mm) to about 0.060 inch (1.5 mm), a thickness of about 0.040 inch (1 mm) being presently preferred. With such relatively small thickness, it has been found that the edge 32 of the overlapping liner sheet does not form any particularly noticeable seam mark in the concrete column that would require finishing to remove.

Once the form 10 has been assembled, the form is then erected to a vertical position in the desired location for the column, and is secured in suitable fashion with an external framework of wood or the like so that the form will maintain its desired vertical orientation when concrete is poured into the form. The concrete is then poured into the form in the usual manner; a vibrating finger or other means for minimizing air bubbles and pockets in the concrete typically can be used. After the concrete has sufficiently hardened, the outer tube 12 is stripped away. One or more tear strings or wires (not shown) can be provided between the inner surface of the tube and the insert assemblies 20, extending along the full length of the tube. Pulling the tear wire(s) causes the tube to be severed along one or more longitudinal lines so that the tube can then be opened up and removed from the insert assemblies that remain on the concrete column. Once the outer tube has been stripped away, the insert assemblies can then be separated from the concrete column. Because the insert assemblies are essentially waterproof and the concrete is substantially prevented from infiltrating into or adhering to the insert assemblies, the insert assemblies can be removed in a substantially clean condition and can be reused one or more additional times.

Figure 7:
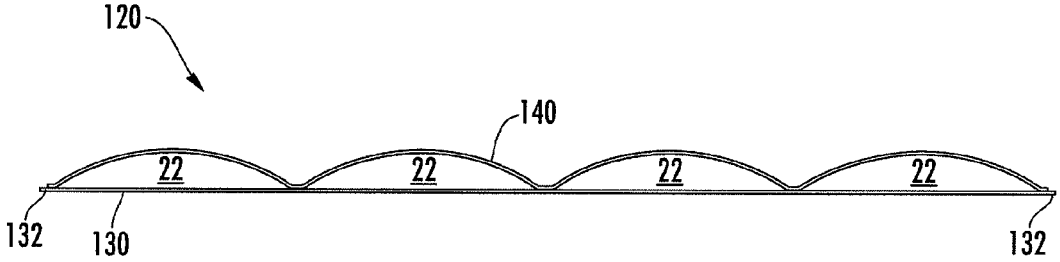
FIG. 7 is a cross-sectional view of an insert assembly in accordance with another embodiment of the invention.

A second embodiment of the invention is illustrated in FIG. 7, which depicts an insert assembly 120 that is configured for making a square or rectangular column with beveled corners generally as in the first embodiment. Instead of two separate insert assemblies, in this embodiment a single insert assembly 120 is used. This approach is particularly useful for making columns of smaller dimensions such as about 15 inches by 15 inches or less. The insert assembly comprises a plurality of cellular material pieces 22 arranged in four rows and substantially fully enveloped between a liner sheet 130 and a backing sheet 140. To use the insert assembly 120, it is folded into a shape that allows it to be inserted into the outer tube and is then positioned with the backing sheet on the cellular material pieces abutting the inner surface of the tube. The opposite side edges 132 of the liner sheet 130 are overlapped generally as described in connection with FIG. 2A. The form is then erected and filled with concrete, and the form is removed from the column in the manner previously described.

The concrete form 10 and insert assemblies 20, 120 described and illustrated herein have a plurality of separate cellular material pieces 22 in each row that extends the length L of the outer tube 12. Alternatively, however, it is possible (particularly with shorter columns) for a given row to comprise a single cellular material piece of length L.

The concrete forms described herein have a number of notable advantages. The insert assemblies 20, 120 can be folded and/or can be nested with one another in a space-efficient manner for shipping and storage prior to use. The outer tubes 12 also can be nested, for example when shipping a collection of tubes of different diameters (e.g., a 30-inch tube can receive a 24-inch tube, which can receive a 20-inch tube, which can receive a 15-inch tube, etc.). Additionally, the insert assemblies are essentially waterproof and thus are not degraded by exposure to the concrete or to the elements. The insert assemblies are reusable. Assembly of the forms in the field is simple and does not require great skill or heavy equipment. The insert assemblies are light in weight and substantially rigid in the length direction so that a worker can easily carry an insert assembly without having to use equipment for moving the insert assemblies about on a jobsite.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. A method for making a concrete form for pouring a column having a non-round cross-section, comprising the steps of:

(a) providing an outer tube having a cylindrical inner surface and a length L;

(b) providing a first plurality of pre-fabricated cellular material pieces each having opposite first and second surfaces, the first surface of each cellular material piece being configured to form a portion of the non-round cross-section desired for the column and the second surface of each cellular material piece being formed substantially as an angular section of a cylinder, each cellular material piece having a width defined between opposite side edges and a length defined between opposite ends of the cellular material piece;

(c) providing a first pre-formed polymer liner sheet having a length approximately equal to L;

(d) providing a first pre-formed polymer backing sheet having a length approximately equal to L;

(e) arranging the first plurality of cellular material pieces on the first liner sheet in a plurality of laterally adjacent rows with the first surfaces of the cellular material pieces against the first liner sheet and affixing the first liner sheet to the first surfaces of the cellular material pieces, each row having a length approximately equal to L;

(f) affixing the first backing sheet to the second surfaces of the first plurality of cellular material pieces to form a first insert assembly, the first liner sheet and first backing sheet together substantially fully enveloping the cellular material pieces;

(g) repeating steps (c) through (f) with a second pre-formed polymer liner sheet, a second pre-formed polymer backing sheet, and a second plurality of cellular material pieces to form a second insert assembly having a plurality of rows of the cellular material pieces substantially fully enveloped by the second liner sheet and second backing sheet; and (h) inserting the first and second insert assemblies into the outer tube and arranging the insert assemblies such that the backing sheets abut the inner surface of the tube and the liner sheets on the first surfaces of the cellular material pieces of the first and second pluralities of cellular material pieces define the non-round cross-section desired for the column.

2. The method of claim 1, wherein the lengths of the cellular material pieces of the first and second pluralities of cellular material pieces are less than L and each row comprises a plurality of the cellular material pieces arranged end-to-end collectively having a length of approximately L.

3. The method of claim 1, wherein the cellular material pieces of the first and second pluralities of cellular material pieces are formed with planar first surfaces and the insert assemblies are arranged in the outer tube to define a rectangular or square cross-section.

4. The method of claim 2, wherein opposite side edges of the first and second liner sheets of the insert assemblies extend laterally beyond outer side edges of the cellular material pieces of the first and second pluralities of cellular material pieces, and the insert assemblies are arranged in the outer tube such that each side edge of the first liner sheet overlaps or is overlapped by one of the side edges of the second liner sheet.

5. The method of claim 4, wherein laterally extending gaps are defined between the rows of the first plurality of cellular material pieces and between the rows of the second plurality of cellular material pieces, and the insert assemblies are arranged in the outer tube such that the gaps and the overlapping side edges of the liner sheets define chamfered corners for the concrete column.

6. A concrete form for pouring a column having a non-round cross-section, comprising:

an outer tube having a cylindrical inner surface and a length L;

a first insert assembly comprising:

a first pre-formed polymer liner sheet having a length approximately equal to L;

a first pre-formed polymer backing sheet having a length approximately equal to L;

a first plurality of pre-fabricated cellular material pieces each having opposite first and second surfaces, the first surface of each cellular material piece being configured to form a portion of the non-round cross-section desired for the column and the second surface of each cellular material piece being formed substantially as an angular section of a cylinder, the first plurality of cellular material pieces being arranged on the first liner sheet in a plurality of laterally adjacent rows with the first surfaces of the cellular material pieces against the first liner sheet and affixed thereto, each row extending a length approximately equal to the length L of the outer tube;

the first backing sheet being affixed to the second surfaces of the first plurality of cellular material pieces, the first liner sheet and first backing sheet together substantially fully enveloping the first plurality of cellular material pieces; and a second insert assembly comprising:

a second pre-formed polymer liner sheet having a length approximately equal to L;

a second pre-formed polymer backing sheet having a length approximately equal to L;

a second plurality of pre-fabricated cellular material pieces each having opposite first and second surfaces, the first surface of each cellular material piece being configured to form a portion of the non-round cross-section desired for the column and the second surface of each cellular material piece being formed substantially as an angular section of a cylinder, the second plurality of cellular material pieces being arranged on the second liner sheet in a plurality of laterally adjacent rows with the first surfaces of the cellular material pieces against the second liner sheet and affixed thereto, each row extending a length approximately equal to the length L of the outer tube;

the second backing sheet being affixed to the second surfaces of the second plurality of cellular material pieces, the second liner sheet and second backing sheet together substantially fully enveloping the second plurality of cellular material pieces;

the first and second insert assemblies being inserted into the outer tube and arranged such that the backing sheets abut the inner surface of the tube and the liner sheets on the first surfaces of the cellular material pieces of the first and second pluralities of cellular material pieces define the non-round cross-section desired for the column.

7. The concrete form of claim 6, wherein the lengths of the cellular material pieces of the first and second pluralities of cellular material pieces are less than L and each row comprises a plurality of the cellular material pieces arranged end-to-end collectively having a length of approximately L.

8. The concrete form of claim 6, wherein the cellular material pieces of the first and second pluralities of cellular material pieces are formed with planar first surfaces and the insert assemblies are arranged in the outer tube to define a rectangular or square cross-section.

9. The concrete form of claim 8, wherein opposite side edges of the first and second liner sheets of the insert assemblies extend laterally beyond outer side edges of the cellular material pieces of the first and second pluralities of cellular material pieces, and the insert assemblies are arranged in the outer tube such that each side edge of the first liner sheet overlaps or is overlapped by one of the side edges of the second liner sheet.

10. The concrete form of claim 9, wherein laterally extending gaps are defined between the rows of the first plurality of cellular material pieces and between the rows of the second plurality of cellular material pieces, and the insert assemblies are arranged in the outer tube such that the gaps and the overlapping side edges of the liner sheets define chamfered corners for the concrete column.

11. The concrete form of claim 6, wherein the liner and backing sheets comprise films made of a polymer selected from the group consisting of polyvinyl chloride, polypropylene, polyethylene, polystyrene, polyester, polyamide, and polytetrafluoroethylene.

12. The concrete form of claim 6, wherein the liner and backing sheets comprise polypropylene films having a thickness of about 0.010 inch to about 0.060 inch.

13. The concrete form of claim 6, wherein the cellular material pieces of the first and second pluralities of cellular material pieces comprise expanded polystyrene.

* * * * *